US009375040B2

(12) United States Patent
Rosenbaum

(10) Patent No.: US 9,375,040 B2
(45) Date of Patent: Jun. 28, 2016

(54) DEPLOYABLE GARMENT VENTING DEVICE

(71) Applicant: Robert Rosenbaum, Gaithersburg, MD (US)

(72) Inventor: Robert Rosenbaum, Gaithersburg, MD (US)

( * ) Notice: Subject to any disclaimer, the term of this patent is extended or adjusted under 35 U.S.C. 154(b) by 701 days.

(21) Appl. No.: 13/684,600

(22) Filed: Nov. 26, 2012

(65) Prior Publication Data

US 2013/0139296 A1 Jun. 6, 2013

Related U.S. Application Data

(60) Provisional application No. 61/566,451, filed on Dec. 2, 2011.

(51) Int. Cl.
*A41D 27/28* (2006.01)

(52) U.S. Cl.
CPC ..... *A41D 27/28* (2013.01)

(58) Field of Classification Search
CPC . A41D 27/28; A41D 13/015; A41D 13/0158; A41D 2200/10; A41D 2200/20; A41D 2200/22; A41D 2200/24; A41D 2400/20; A41D 2400/22; A41D 2400/424; A41D 2400/42
USPC ..... 2/243.1, 76, 220, 221, 236, 237, 267, 2/268, DIG. 1, 319, 272
See application file for complete search history.

(56) References Cited

U.S. PATENT DOCUMENTS

| | | | | | |
|---|---|---|---|---|---|
| 776,003 | A * | 11/1904 | Wellman | 607/84 |
| 827,897 | A * | 8/1906 | Warshauer | 2/337 |
| 1,080,985 | A * | 12/1913 | Leap | 2/320 |
| 1,365,472 | A * | 1/1921 | Ek | 2/220 |
| 2,423,168 | A * | 7/1947 | Barritz | 2/268 |
| 2,448,141 | A * | 8/1948 | Farrell | 2/268 |
| 3,213,465 | A * | 10/1965 | Ludwikowski | 2/87 |
| 5,598,583 | A * | 2/1997 | Victor et al. | 2/46 |
| 5,676,094 | A * | 10/1997 | Gun-Munro | 119/850 |
| 6,442,760 | B2 | 9/2002 | Moretti | |
| 7,636,955 | B2 | 12/2009 | Plut | |
| 8,122,520 | B2 * | 2/2012 | Wilson, II | 2/237 |
| 8,276,213 | B2 | 10/2012 | Maurer | |
| 2010/0186149 | A1 * | 7/2010 | Miller | 2/337 |
| 2013/0263361 | A1 * | 10/2013 | Surya | 2/243.1 |

* cited by examiner

*Primary Examiner* — Andrew W Collins
(74) *Attorney, Agent, or Firm* — Daniel Boudwin; Global Intellectual Property Agency, LLC.

(57) ABSTRACT

Disclosed is a deployable garment venting device that offsets the beltline of a wearer's trousers from the body of the wearer to allow an air gap such that heat and moisture is released and airflow is achieved across the trouser beltline. The device comprises a flexible frame member bordering an internal mesh web. The preferred embodiment comprises a pair of straps that deform the frame into a deployed state, bowing out the frame and creating a non-planar structure to offset a trouser beltline. The straps comprise clips for attachment to the wearer's beltline, whereby the frame can be released from the strap tension and thus stowed against the user's body in a planar state. Embodiments include of the frame straps include hooks that releasable maintain the frame's distorted shape, tensionable straps, and a frame that folds onto itself when disconnected from the user for condensed storage.

9 Claims, 4 Drawing Sheets

DEPLOYABLE GARMENT VENTING DEVICE

CROSS REFERENCE TO RELATED APPLICATION

This application claims the benefit of U.S. Provisional Application No. 61/566,451 filed on Dec. 2, 2011, entitled "Utilities Trouser Venting System." The above identified patent application is herein incorporated by reference in its entirety to provide continuity of disclosure.

BACKGROUND OF THE INVENTION

1. Field of the Invention

The present invention relates to ventilated garments and means for venting heat and moisture from within a wearer's clothing. More specifically, the present invention relates to a belt-worn, rapidly deployable and stowable structure that provides clearance between a wearer's lower back and the wearer's trouser waistline, whereby a pathway is established to dissipate heat and moisture from within a wearer's trousers.

The human body has several mechanisms for regulating its body temperature to maintain homeostasis. These include the flow of heat to the body's extremities, conduction and convection of heat from the surfaces of the body, radiated heat to and from the environment, and evaporative cooling via sweat evaporation. It is well understood that the human body needs to regulate its internal temperature within a narrow range in order to remain healthy. Excessive heat can cause physiological stress that can lead to injury, including heat exhaustion and heat stroke. For most individuals, this involves wearing climate-appropriate apparel to keep warm or to remain cool; however for individuals such as field workers, military serviceman, and business professionals, the ability to choose apparel may be limited to longer, bulkier and more restrictive clothing given work requirements, the work environment, designated uniform and safety standards or precautions necessary for the given task.

Military uniforms, combat uniforms, construction clothing and professionals in suits are all susceptible to overheating on hot days and in high humidity, high temperature environments. The ability for the body to regulate its temperature by releasing heat is reduced since most of its surface area is covered, preventing heat from dissipating and trapping moisture. The present invention is particularly concerned with the trapping of heat and moisture within long pants or trousers, which can cause excessive sweating and poor regulation of body heat. The ability to vent heat and moisture from trousers provides a means to reduce the heat trapped therein and create a flow of air that can draw heat away from the body and increase evaporative cooling. This is particularly true on hot summer days, in tropical or desert environments, and in those environments where the base of the wearer's pants are tucked into or secured to the boot upper.

Various structures have been developed for venting garments in the art; however a clear need exists in the art for a device that can vent a pair of trousers while providing for ease of deployment. Most vents are sewn into the garment, which is not possible for uniforms or for professional attire. The introduction of spacer elements between the user and the garment is useful for creating air flow and letting heat escape, but the spacers themselves are not conveniently stowable or carriable between uses. The present invention contemplates a structure that offsets a wearer's trousers along the waistline using a readily deployable structure that can remain in a stowed state without requiring the user to carry or otherwise handle the device in between uses. Specifically, an offset device having a deformable frame supporting a mesh material is disclosed, which preferably clips to a wearer's waistline and is bent into its working shape when deployed and released when the offset is not required. When released, the device remains clipped to the wearer but is not creating an offset, does not requiring handling or stowage, and can be hidden within the user's clothing to lower its visual signature.

2. Description of the Prior Art

Devices have been disclosed in the prior art that relate to garment ventilation means. These include devices that have been patented and published in patent application publications, and generally relate to articles of clothing having zippered openings, vents and other structures for providing a pathway for air and moisture to escape a wearer's article of clothing. None of the prior art devices reflect a belt-worn member that expands when deployed to provide an air gap for heat to escape a wearer's pants while in hot and humid climates. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 6,442,760 to Moretti discloses a ventilated item of clothing that comprises a plurality of spacer elements that are arranged along the internal part of the user's shoulders within an item of clothing. The spacer elements create a gap between the clothing item and the wearer's shoulders, while a venting element allows heat within the gap to escape through the shoulder region of the garment. The venting element is a mesh screen that allows moisture and heat to dissipate, while the spacer elements are supported by the wearer's shoulders and prop the shoulder region of the garment away from the body of the user. While disclosing a static means of venting one's upper body garment, the Moretti device is limited to static configurations, where the spacer elements are continually deployed. The present invention pertains to a deployable and stowable spacer structure that clips to a wearer's trousers to provide an air gap between the lower back of the user and the top of the trousers for heat dissipation.

Similar to Moretti is U.S. Pat. No. 7,636,955 to Plut discloses a protective article of apparel that includes a plurality of spacers configured to maintain a buffer volume within the body portion between the apparel material and the wearer. The spaces include compliant members adapted to be placed along the wearer's neck, establishing an air channel leading toward a head shroud on a protective or hazardous material suit to facilitate ventilation and air exchange in an out of the hood. The Plut device is adapted to provide an offset between a hazardous material suit and a wearer to improve airflow, reduce heat and increase breathing of the user. Air passes through a filter and flows through the suit for heat regulation and improved breathing. The Plut device, however, provides a structure that is significantly divergent in intent and design from that of the present invention, which is designed for normal and utility trousers in hot work environments.

Other devices relate to apparel venting devices that employ openable structures or zippered vent locations to release heat from within a garment. Most of these devices relate to heavy jackets and motorcycle protective gear that provide vents for heat and moisture release or for providing a year-round weather jacket. One such device that exemplifies this area of the art is U.S. Pat. No. 8,276,213 to Maurer, which discloses a venting mechanism having an opening, a zipper closure, a mesh arrangement to prevent objects from entering through the closure and a no-catch mechanism for securing closed the opening without snagging the mesh. Devices of this type are deployed on garments of all types and are built into the structure of the garment. The present invention, by contrast, provides a readily deployable structure that offsets the waistline of a pair of trousers for heat release, wherein the structure is attachable to any existing trousers or can be manufactured to be connected thereto. This provides flexibility with regard to deployment and stowage of the device, as desired by the wearer and as necessary to provide a venting system for existing garments.

The present invention comprises a netted frame that is flexible into a bowed shape, whereby the outer frame member is secured into a compressed configuration by a pair of straps while the mesh membranes to offset the wearer's trouser beltline from the waist of a wearer. This allows air to flow in and out of the wearer's trousers, releasing heat and thereby improving heat regulation in hot climates and while wearing full length trousers. It is submitted that the present invention is substantially divergent in design elements from the prior art, and consequently it is clear that there is a need in the art for an improvement to existing trouser venting devices. In this regard the instant invention substantially fulfills these needs.

SUMMARY OF THE INVENTION

In view of the foregoing disadvantages inherent in the known types of garment venting means now present in the prior art, the present invention provides a new trouser venting device that can be utilized for providing convenience for the user when exhausting heat and moisture from within a wearer's trousers while allowing air flow therein by offsetting the rear beltline of the wearer's trousers from the wearer.

It is therefore an object of the present invention to provide a new and improved trouser venting device that has all of the advantages of the prior art and none of the disadvantages.

It is another object of the present invention to provide a trouser venting device that offsets a wearer's trouser beltline along the wearer's lower back to provide a gap therebetween for ventilation of heat and moisture.

Another object of the present invention is to provide a trouser venting device is to provide a readily deployable structure that does not require handling prior to or in between uses, whereby the device can be easily stowed when not in a working state.

Yet another object of the present invention is to provide a trouser venting device that offers a trouser ventilation means for military servicemen, business professionals and uniformed workers in hot and humid environments.

Another object of the present invention is to provide a trouser venting device that comprises a flexible frame and a mesh interior that forms a structure when in a working state to allow a gap between a pair of trousers and a user, where several methods of deployment are contemplated for ease of use for existing garments.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
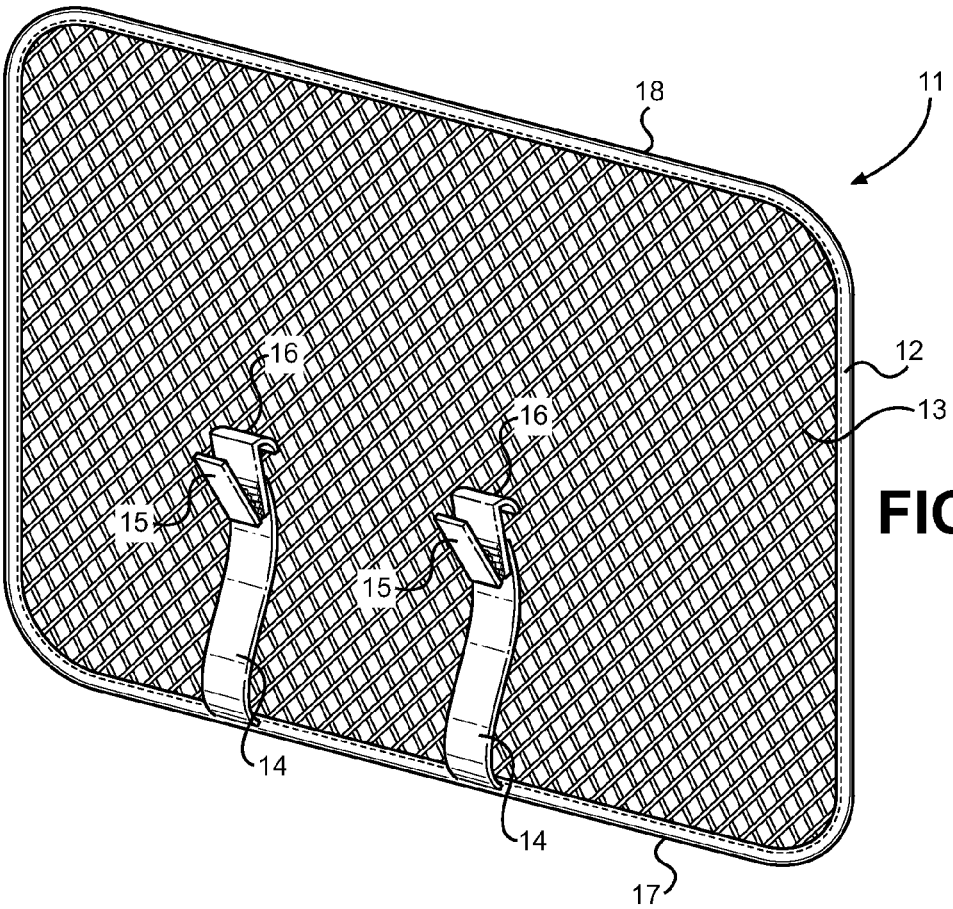
FIG. 1 shows a perspective view of an exemplary embodiment of the present invention in a non-deployed state.

Reference is made herein to the attached drawings. Like reference numerals are used throughout the drawings to depict like or similar elements of the trouser venting device. For the purposes of presenting a brief and clear description of the present invention, the preferred embodiment will be discussed as used for allow air to enter and escape a wearer's trousers in hot and humid climates while providing a rapid means of deployment. The figures are intended for representative purposes only and should not be considered to be limiting in any respect.

Referring now to FIG. 1, there is shown a perspective view of the trouser venting device 11 of the present invention in an un-deployed state. The device comprises a planar structure having a flexible perimeter frame 12 and an interior web 13 of elastic, netted material that allows airflow therethrough and conforms to the shape of the perimeter frame. The frame 12 includes an upper edge 18 and a lower edge 17, wherein a first and second strap 14 connects to and extends from the frame lower edge 17. In a preferred embodiment, the straps 14 are elongated members connected at their first end to the frame lower edge 17 and terminating at their second end short of the frame upper edge 18. Each strap second end comprises a spring clip or alligator clip 15 that are capable of securely grasping an object within a pair of hinged members biased together. The clips secure the straps to the beltline of a user's trousers such that the straps extend downward from the beltline and the mesh frame is placed between the interior of the trousers and the wearer's lower back. The device is free to be positioned in this fashion without altering the user's normal clothing in the instances where ventilation is not required. When ventilation is desired, the upper edge 18 of the frame can be forced downward toward the clips 15 along the beltline, which further include an inwardly directed hook or ledge 16 adapted to secure over the upper edge 18 of the frame as it is forced downward. The frame 12 is compressed as the upper edge 18 is forced downward toward the lower edge 17, while the hooks 16 are used to secure the upper edge 18 and allow the frame and web to create a non-planar structure that establishes an offset between the user's trousers and the user's back. The offset forces the trousers away from the user to create an air gap for ventilation purposes.

The web 13 of the device 11 is a flexible material having a plurality of apertures and an elastic structure such that as the frame 12 is compressed into a deployed state, the web membranes and conforms to the updated, non-planar structure of the frame that offsets a wearer's beltline and allows air flow therethrough. The straps 14 and the shape of the frame/web create the non-planar structure, which improves air movement and ventilation of the air within the user's trousers. The frame 12 is a flexible wire member or similar elastic structure that naturally forms a defined planar structure in its ground state, but is readily deformed by the user into a deployed shape. Once the frame is compressed by the straps 14, the frame assumes a defined double-lobe or oval shape, where the straps are under tension as the frame is biased to return to its original shape and bends out of plane to create a structure that can force the user's trousers away from his or her body.

Figure 2:
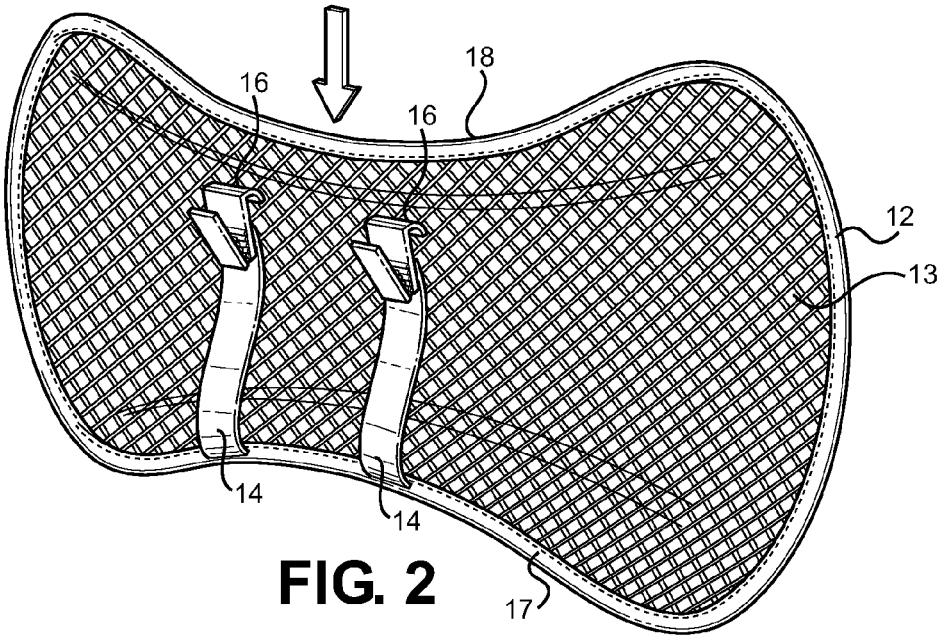
FIG. 2 shows a view of the present invention being compressed into a deployed state.

Referring now to FIG. 2, there is shown a view of the present invention being compressed into a deployed shape, where the frame upper edge 18 is pressed toward the lower edge 17 and secured by the strap hooks 16. This action can be accomplished while the device is attached to a user's trousers and the user requires ventilation, which provides a structure that can be readily deployed in active work situations. The frame 12 deforms as the upper edge 18 and lower edge 17 are brought together, whereby the mesh 13 is stretched to accommodate the deformed shape of the frame 12 and the ends of the frame 12 form an oval shape. The deployed state is a non-planar structure that when positioned between a user's trousers and the user's back an air gap is created to vent heat and moisture from within the user's trousers. In a preferred embodiment, the straps 14 are defined and equal lengths and are non-adjustable, and the frame midsection width conforms to the length of the straps when the upper and lower edges are secured together. The web membranes into a deformed shape, which is an alternate structural mode based on the updated boundary shape of the frame from its original shape. The design of the un-deformed frame is contemplated as taking several forms, the simplest of which is a rectangular frame having rounded edges. The rounded edges allow the frame ends to form a contoured shape more readily than a rectangular starting shape having square edges. The shape of the frame can be provided in several shapes depending on the requirements of the user or application, falling within the scope of the present invention. It is not desired to limit the present invention to a single design or shape, but rather to illustrate the function of the present invention and embodiments that have been shown to be functional.

Figure 3:
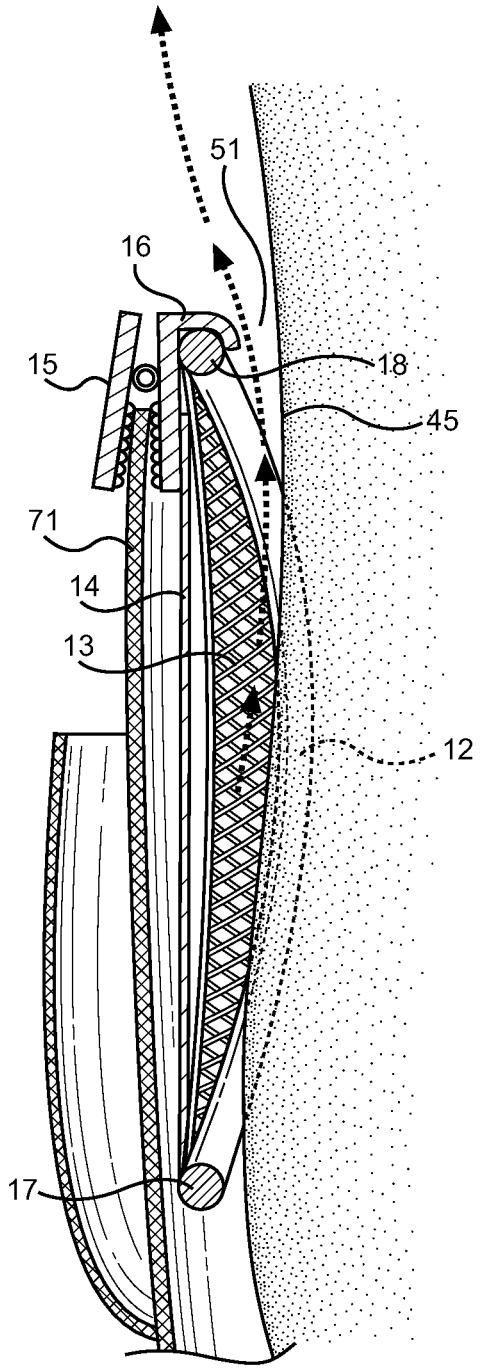
FIG. 3 shows a cross section view of the present invention in connection with a wearer's beltline and in a deployed state, providing an airway to vent heat and moisture.

Referring now to FIG. 3, there is shown a cross section view of the present invention in a working position, creating a gap 51 between the lower back 45 of a user and the beltline 71 of the user's trousers. The device is clipped 15 to the user's trousers while the upper edge 18 of the frame is secured to the first and second clip hooks 16 that draw the frame together and create a non-planar structure to establish an offset between the user's trousers and his or her body. The shortened strap 14 lengths deform the frame such that the trousers 71 are pressed away from the user to allow heat and moisture to escape in hotter environments. The webbing 13 and the outer portions of the frame press against the user while the upper and lower edges of the frame and the straps 14 are offset from the user's body to force the trousers away from the user's body 45.

The present invention is designed to offer users the ability to vent their pants or shorts in hotter environments to avoid overheating and discomfort. A primary concern is the ease of deployment of the device and the ability to carry the device on the user's person without requiring the user to manually carry it or have it take up space in an article of luggage or a carry pack. The preferred embodiment contemplates the device being positioned within and attached to a pair of trousers in a planar shape (FIG. 1), and when needed for ventilation the frame is simply deformed into its non-planar shape to offset the beltline of the trousers. The device is clipped to the trousers, or may alternatively be built into the trousers as a permanent solution; however the removably attachable embodiment offers greater flexibility with respect to use with existing garments and complete removal of the device when not desired (such as in colder or milder climates).

Figure 4:
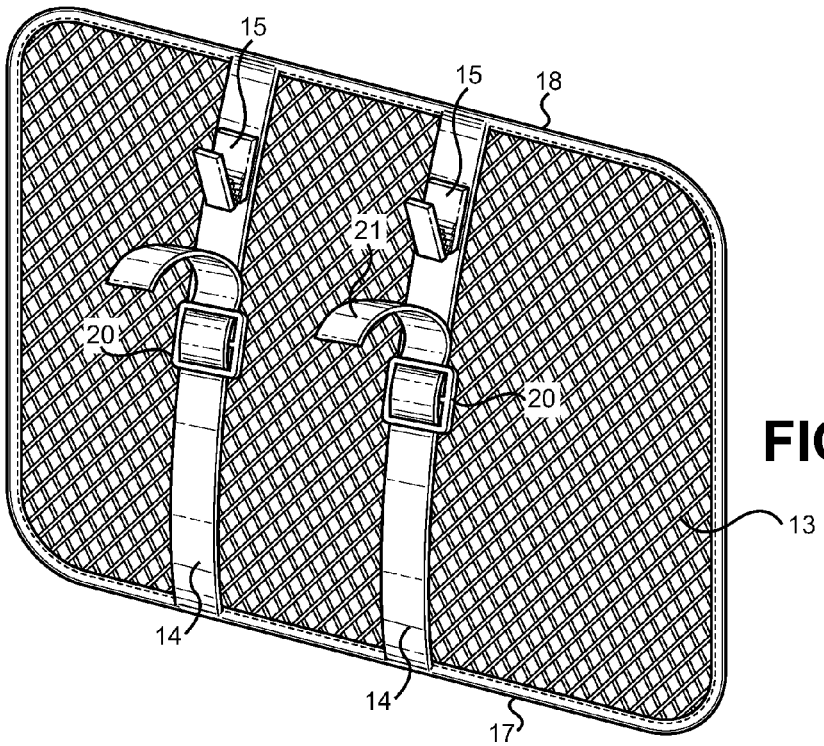
FIG. 4 shows an alternate embodiment of the present invention.

Referring now to FIG. 4, there is shown a view of an alternate embodiment of the present invention, which contemplates the use of straps that extend from the upper edge 18 to the lower edge 17 of the frame and utilize strap adjuster elements 20 to deform the frame into its deployed state. This embodiment requires more parts and longer straps than the preferred embodiment, but is useful alternative for transitioning the frame and its interior web 13 from a planar structure to one that offers an offset to allow air flow therethrough. The device is clipped to the interior of a user's trousers, whereafter the free ends 21 of each strap are pulled upwards by the user to shorten each strap 14 length, drawing the frame together into a desired shape. Along each strap 14 is the same trouser clip 15 as provided in the preferred embodiment for securing the assembly to a trouser beltline.

Figure 5:
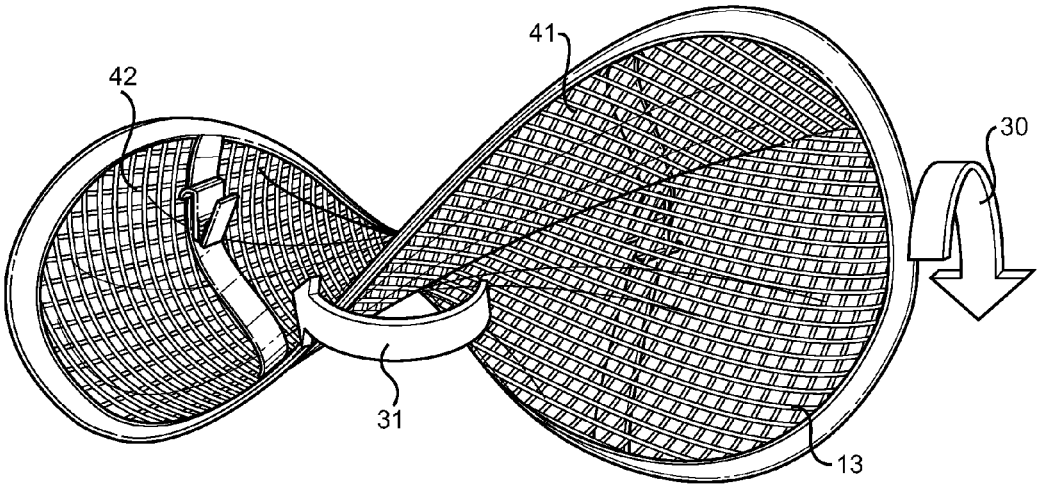
FIG. 5 shows yet another embodiment of the present invention.

Referring now to FIG. 5, there is shown yet another embodiment of the present invention. In this embodiment, the device is provided in a permanently non-planar shape, wherein the strap lengths are not adjustable but span the gap between the upper and lower edge of the frame to maintain a deformed frame structure. The frame is permanently in a deformed shape such that deployment requires placement of the device between the user's trousers and the user's lower back for creation of a ventilation gap, whereby the device is clipped to the user's beltline if desired. To stow the device, however, the flexible frame and mesh 13 can be condensed into a smaller, stowed volume by twisting 30 the first 42 and second 41 ends of the frame opposite of one another and forcing 31 them together such that they collapse into a planar structure. The flexible wire frame collapses together such that the stowed state of the device can be easily carried on the user's person or in a carry bag. This embodiment has no movement parts or adjustable straps, and is deployed by unraveling the device from its stowed and collapsed state.

Figure 6:
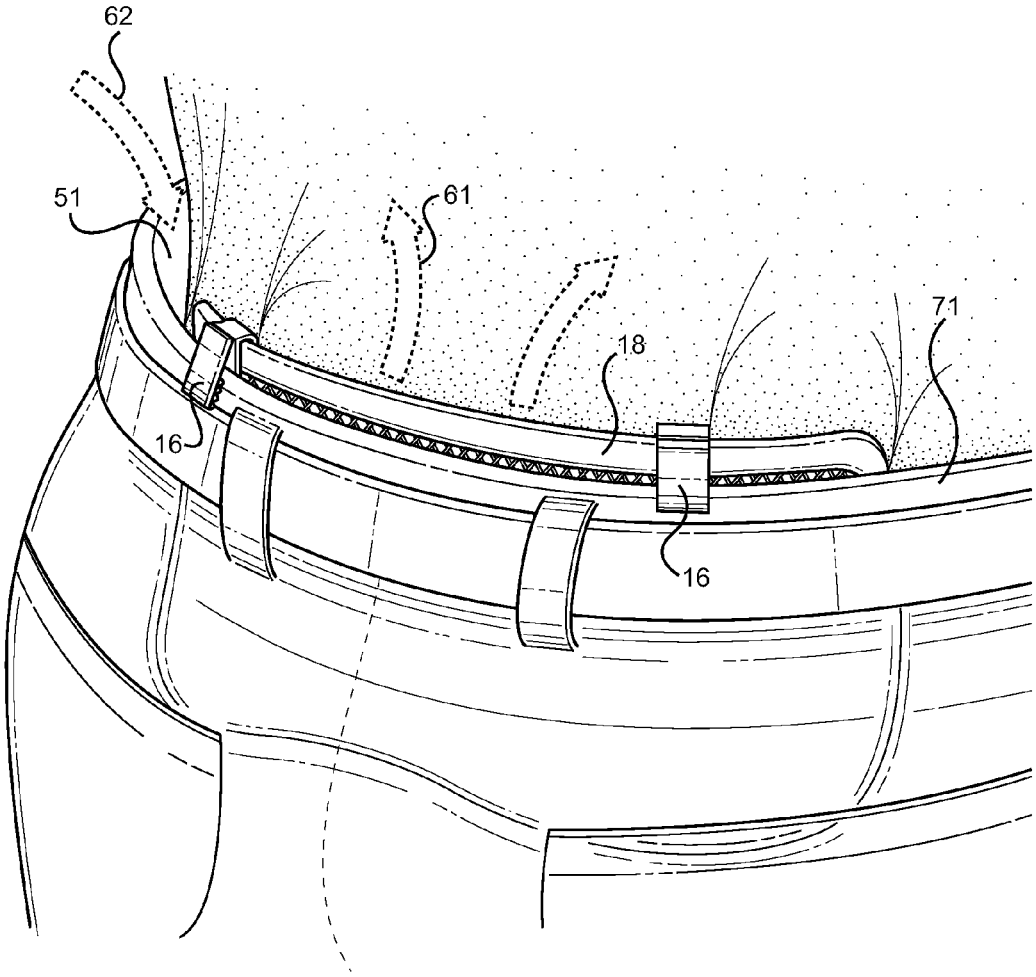
FIG. 6 shows a view of the present invention in a working state and deployed on a wearer's beltline.

Referring finally to FIG. 6, there is shown a view of the present ventilation device in a working state, positioned between the beltline 71 of a user's trousers and the body of the user to create an air gap 51 therebetween. The device provides an offset spacer when deployed that allows air to flow through its mesh structure to release 61 heat and moisture and provide air flow 62 into the trousers. In the preferred embodiment, the device clips 16 to the user's beltline and can remain in this position in either a planar (non-functioning) configuration or in a non-planar (deployed) configuration. When in a planar configuration, the upper edge 18 of the frame rises above the beltline 71 and is flush with the user's back. To deploy the device into a non-planar configuration, the user forces the upper edge 18 of the frame under the hooks of the clips 16 to deform the frame and force the user's trousers away from his or her body. This provides an air gap 51 and allows air flow and heat exchange. Alternate configurations beyond the foregoing include permanent connection of the strap members to the interior of the trousers, where the clips are removable trouser attachment means and are replaced by permanent attachment means in an embodiment. The device is therefore provided within the trousers during their manufacturing and includes a permanent fastener and an interior hook to adapt the attached frame from a planar to deployed state without the use of clips.

The present invention is ideal for military personnel, business professional and professional workers that have to wear specific attire, uniforms or protective gear in working environments. High temperature and humid environments can rapidly cause overheating concerns, particularly for those wearing long pants and heavier construction pants that limit or restrict breathability. When people are doing activities outdoors or in harsh environments, they can quickly become overheated and uncomfortably hot if they are required to wear pants or trousers. Since the waistband of most styles of pants or protective gear generally sits snug around the waist, there is no way for warm air to be ventilated from the upper portion of the pants and for air to enter and improve cooling. The present invention provides a deformable spacer structure that includes a mesh or woven material within a frame that attaches to a user's beltline. The frame forms a non-planer working state that forces the user's trousers away from the user during deployment. This allows excess heat, which normally collects inside clothing, to escape and be replaced by fresh air as the wearer ambulates. Military personnel, law enforcement officials, postal service workers, hikers, laborers, or anyone who gets hot or overheated while performing activities can benefit from both the utility and the ease of deployment of the present invention.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment offset venting device, comprising:

an elastic frame member, said frame member defining a perimeter and having a mesh spanning the frame member;

the mesh configured to allow air to flow therethrough;

said frame member having an upper edge and a lower edge;

at least one strap member having a first end and a second end;

the at least one strap member including a first end connected to the lower edge and a second end;

the second end having a garment connector on a first side thereof and a hook on a second side thereof, the second side opposing the first side;

the hook connectable to the upper edge;

wherein a length of the at least one strap member is less than a distance along the mesh between the upper edge and the lower edge;

said elastic frame member having a planar state;

wherein when the hook is connected to the upper edge, the at least one strap member pulls the upper edge to the lower edge and deforms the frame member from the planar state to a non-planar state;

wherein the frame member is biased to return to the planar state.

2. The device of claim 1, wherein the garment connector further comprises a removable spring clip.

3. The device of claim 1, wherein the garment connector is permanently affixable to a trouser beltline interior.

4. A garment offset venting device, comprising:

an elastic frame member, said frame member defining a perimeter and having a mesh spanning the frame member;

the mesh configured to allow air to flow therethrough;

said frame member having an upper edge and a lower edge;

at least one strap member having a first end, a second end, a first side, a second side facing towards the mesh, and a strap adjuster;

the first side opposing the second side;

a garment connector disposed on the first side;

said strap member first end connecting to said lower edge, said strap member second end connecting to said upper edge;

said frame member having a planar state;

wherein when a length of the at least one strap is shortened by the strap adjuster such that the at least one strap has a length less than a distance along the mesh between the upper edge and the lower edge, the at least one strap member pulls the upper edge to the lower edge and deforms the frame member from the planar state to a non-planar state;

wherein the frame member is biased to return to the planar state.

5. The device of claim 4, wherein the garment connector further comprises a removable spring clip.

6. The device of claim 4, wherein the garment connector is permanently affixable to a trouser beltline interior.

7. A garment offset venting device, comprising:

an elastic frame member, said frame member defining a perimeter and having a mesh spanning the frame member;

the mesh configured to allow air to flow therethrough;

said frame member having an upper edge and a lower edge;

at least one strap member having a first end and a second end;

said strap member first end connecting to said lower edge, said strap member second end connecting to said upper edge;

wherein a length of the at least one strap member is less than a distance along the mesh between the upper edge and the lower edge;

wherein the at least one strap member holds the frame member in a tensioned, non-planar state;

wherein the frame member is convertible into a planar state by twisting a first end and a second end of the frame member opposite of one another and forcing the first end and the second end together.

8. The device of claim 7, wherein the garment connector further comprises a removable spring clip.

9. The device of claim 7, wherein the garment connector is permanently affixable to a trouser beltline interior.

* * * * *